US006629628B1

(12) United States Patent
Canepari et al.

(10) Patent No.: US 6,629,628 B1
(45) Date of Patent: Oct. 7, 2003

(54) DEVICE CARRIER

(76) Inventors: John Anthony Canepari, 3000 Polk St., Chillicothe, MO (US) 64601; John C. Marcolla, 2123 Oaklawn Dr., Chillicothe, MO (US) 64601

( * ) Notice: Subject to any disclaimer, the term of this patent is extended or adjusted under 35 U.S.C. 154(b) by 0 days.

(21) Appl. No.: 09/626,560

(22) Filed: Jul. 27, 2000

(51) Int. Cl.[7] ..... A45C 13/30

(52) U.S. Cl. ..... 224/222; 224/236; 224/901.4; 224/901.6; 224/930; 24/200; D11/218; 150/112

(58) Field of Search ..... 224/219, 221, 224/222, 236, 250, 901.4, 901.6, 930; 24/171, 196, 197, 200; D11/218; 150/112, 115, 140

(56) References Cited

U.S. PATENT DOCUMENTS

| | | | | | |
|---|---|---|---|---|---|
| 2,754,560 | A | * | 7/1956 | Warner et al. | 24/200 |
| 4,135,653 | A | | 1/1979 | Sieloff | |
| 4,171,555 | A | * | 10/1979 | Bakker et al. | 24/200 |
| 4,257,463 | A | * | 3/1981 | Monaco | 150/110 |
| 4,303,187 | A | * | 12/1981 | Berman | 224/222 |
| 4,432,477 | A | | 2/1984 | Haidt | |
| 4,500,019 | A | | 2/1985 | Curley, Jr. | |
| 4,528,700 | A | * | 7/1985 | Johnston | 2/338 |
| 4,677,711 | A | * | 7/1987 | Anscher | 24/200 |
| 4,896,805 | A | * | 1/1990 | Klaczak et al. | 224/236 |
| 4,913,326 | A | | 4/1990 | Echelson | |
| 5,170,917 | A | * | 12/1992 | Tourigny | 224/211 |

* cited by examiner

*Primary Examiner*—Stephen K. Cronin
(74) *Attorney, Agent, or Firm*—Shook, Hardy & Bacon LLC

(57) ABSTRACT

A device carrier for carrying an electronic device includes a pouch having a rear wall and a pair of straps. Each strap has a first end, a second end and a side. The first ends of the straps are coupled with the rear wall at a distance from one another. Each strap further includes a first section of hook and loop fastening material coupled with the side and proximate to the second end. Each strap also has a second section of complimentary hook and loop fastening material coupled with the side and located between the second end and the first section of hook and loop material. Further, each strap has a buckle coupled with the rear wall. Each strap is secured to the corresponding buckle by placing the second end through the buckle and looping the first end over onto itself so that the first and second sections of hook and loop fastening material are directed toward one another and coupled together.

7 Claims, 2 Drawing Sheets

Fig 5
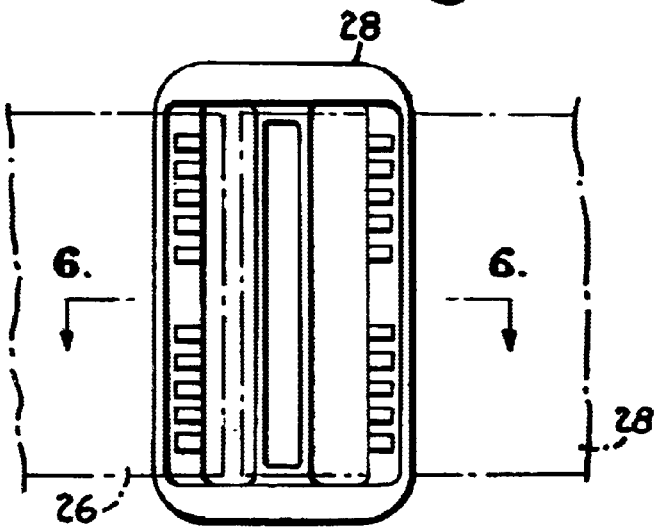
Fig. 6.
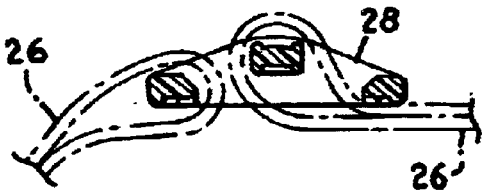
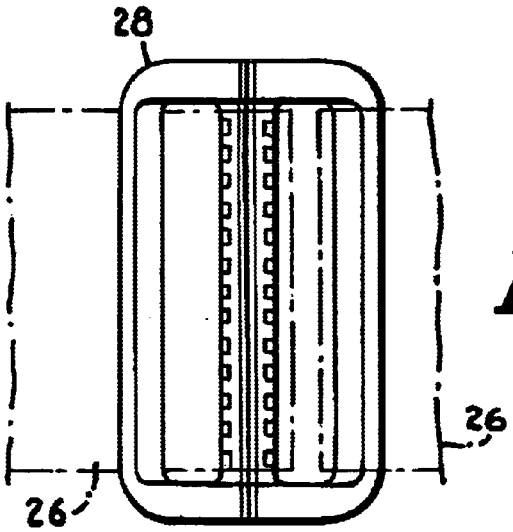
Fig. 7.

DEVICE CARRIER

BACKGROUND OF THE INVENTION

The present invention relates to an apparatus for carrying a portable electronic device. More specifically, this invention relates to a device carrier that can be attached to an individual's arm for holding an electronic device or other articles while an individual is engaged in some form of physical activity.

The proliferation of different types of portable electric devices has increased in recent years. These devices include radios, compact disc players, cassette players, and cellular phones. Individuals use portable electronic devices in many settings, including while engaged in some form of physical activity. This may include running, jogging, biking or other forms of exercise. Thus, there exists a need to carry these devices while keeping a person's hands free to do other activities.

Portable electronic carriers currently exist in a variety of different forms. Some carriers are configured to be worn on the upper arm of an individual to allow easy access to the electronic device. For example, the device may be a portable radio with a headphone jack requiring the user to have a carrier located proximate to the user's head. This configuration, however, may present several problems. To prevent the carrier from slipping down the individual's arm during exercise, a large band is typically used to secure the carrier in place. This, however, may cause significant restriction on the upper arm that may create circulation problems. Another problem is maintaining stability and providing protection for the electronic device. The carrier should securely hold the device and protect it against inadvertent hits, bumps, knocks and collisions within the carrier and from outside the carrier.

Securing the device in the carrier, however, may introduce additional problems. It may be cumbersome, for example, to adjust the volume control on a portable radio or change a music selection on a compact disc player if you have to physically remove the device each time you want to make such an adjustment. Additionally, if the device is properly protected, it may be difficult to access a headphone jack.

Accordingly, there exists a need for a device carrier that can be attached to an individual's arm for holding an electronic device. Moreover, there is a need for a carrier that is comfortable to wear, provides protection for the electronic device and allows easy access to the device. The primary objectives of this invention are to meet these needs.

SUMMARY OF THE INVENTION

More specifically, an object of the invention is to provide a device carrier that can be worn on the upper arm of a user that is comfortable to wear and does not unduly restrict circulation within the upper arm.

Another object of the invention is to provide a device carrier that utilizes adjustable armbands by using the combination of a buckle and a hook-and-loop connector so that a user can easily adjust the tension in the armbands.

Yet another object of the invention is to provide a device carrier that has openings on its sides so that adjustments to the electronic device can be made without opening the top flap.

A further object of the invention is to provide a device carrier made of nylon mesh with foam backing that can stretch to securely hold an electronic device, but can also provide protection to absorb any impact to the electronic device.

In summary, a device carrier for carrying an electronic device includes a pouch having a rear wall and a pair of straps. Each strap has a first end, a second end and a side. The first ends of the straps are coupled with the rear wall at a distance from one another. Each strap further includes a first section of hook and loop fastening material coupled with the side and proximate to the second end. Each strap also has a second section of complimentary hook and loop fastening material coupled with the side and located between the second end and the first section of hook and loop material. Further, each strap has a buckle coupled with the rear wall. Each strap is secured to the corresponding buckle by placing the second end through the buckle and looping the first end over onto itself so that the first and second sections of hook and loop fastening material are directed toward one another and coupled together.

Other and further objects of the invention, together with the features of novelty appurtenant thereto, will appear in the description of the drawings.

BRIEF DESCRIPTION OF THE DRAWINGS

In the following description of the drawings, in which like reference numerals are employed to indicate like parts in the various views:

FIG. 5 is an enlarged elevational front view of the buckle taken along line 5—5 in FIG. 2;

FIG. 6 is a sectional view of the buckle taken along line 6—6 in FIG. 5; and FIG. 7 is an enlarged elevational rear view of the buckle in FIG. 5.

DETAILED DESCRIPTION OF THE DRAWINGS

Figure 1:
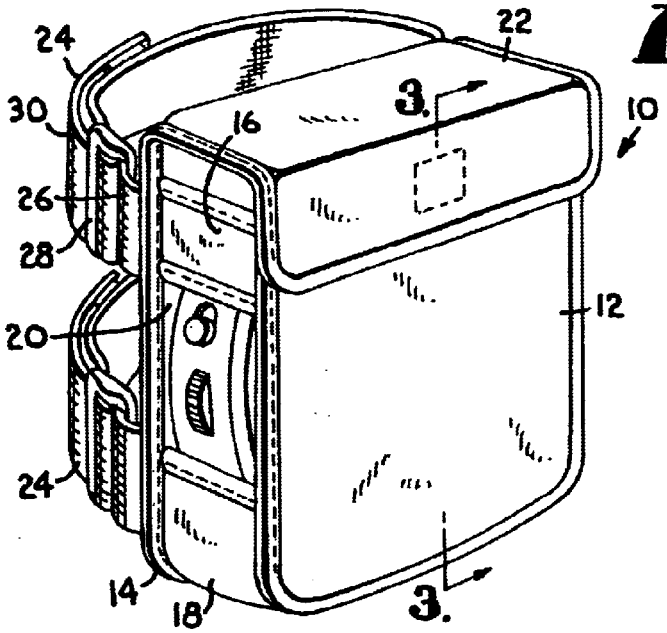
FIG. 1 is a perspective view taken from above of a device carrier constructed in accordance with a preferred embodiment of the present invention.

Referring to the drawings in greater detail, attention is first directed to FIG. 1. A device carrier of the present invention is designated generally by the reference number 10. The device carrier 10 includes a pocket 11 defined by a front wall 12, a rear wall 14 spaced apart from the front wall 12, a pair of side walls 16 between the front wall 12 and rear wall 14, and a base wall 18. The pocket 11 is appropriately sized to hold an electronic device 13. A pair of openings 20 may be formed on either side wall 16 of the device carrier. Alternatively, the side walls 16 and base wall 18 may be constructed as one integrally formed wall with one or more openings formed therein. Additionally, the openings 20 may be formed in any of the described walls to allow access to various controls or ports on the electronic device.

The device carrier 10 further comprises a flap 22 extending from the rear wall 14 at one end and removably coupled with the front wall 12 at the other end. The front wall 12, rear wall 14, flap 22, side walls 16, and base wall 18 are preferably manufactured out of a nylon mesh with foam backing. Preferably, two armbands 24 are attached to the rear wall 14 with each armband having a base strap 26, a buckle 28 connected to the base strap 26 and an adjustment strap 30 selectively connectable to the buckle 28. The base straps 26 and adjustment straps 30 acre manufactured utilizing elastic type material. The armbands 24 are spaced apart a distance approximately equal to one half the width of the armband 24 and are essentially parallel to one another and to the top edge of the rear wall 14. Alternatively, the armbands 24 may be aligned at an angle relative to the top edge oft rear wall 14 and more than two armbands may be utilized in this invention.

Figure 2:
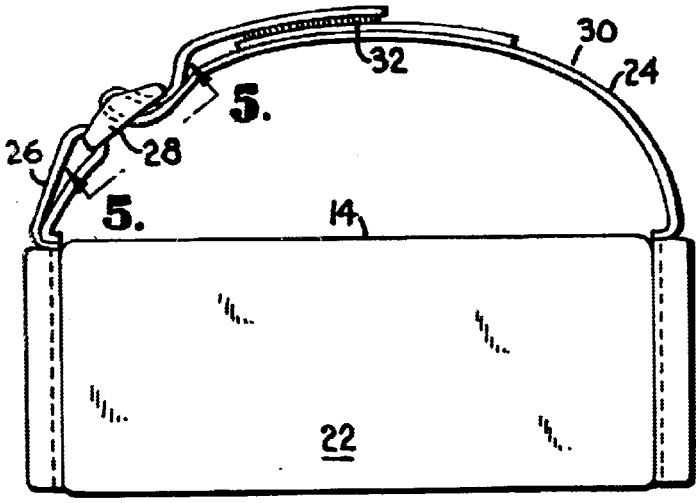
FIG. 2 is a top plan view of the device carrier of FIG. 1.

FIG. 2 is a top plan view of the device carrier of FIG. 1 and further illustrates a preferred configuration of armbands 24. The base strap 26 and the adjustment strap 30 are coupled together using buckle 28 in combination with a hook-and-loop connecting structure 32 such as, for example, VELCRO® fastening material. FIGS. 5, 6 and 7 illustrate a preferred buckle 28 that has a first outer bar 34, a center bar 36, and a second outer bar 38 fixedly connected between two lateral links 40. The base strap 26 is attached to buckle 28 through a first opening 42 formed between the first outer bar 34 and the center bar 36 and has both of its ends fixedly connected to rear wall 14 (FIG. 2). As illustrated in FIG. 2, the adjustment strap 30 has a first end 46 fixedly connected to the rear wall 14 and a second end 47 threaded through buckle 28 and removably attached near the midsection of adjustment strap 30 at connecting structure 32. Specifically, as illustrated in FIG. 6, the adjustment strap 30 is looped through the first opening 42, over the center bar 36 and through the second opening 44 formed between the center bar 36 and the second outer bar 38. As illustrated in FIG. 2, the second end 47 of adjustment strap 30 has one section of hook-and-loop fastening material 48 on a side of adjustment strap 30. A complimentary section of hook-and-loop fastening material 50 is attached on the same side of adjustment strap 30 near the mid-section of adjustment strap 30. Thus, when the base strap 26, the buckle 28 and the adjustment strap 30 are properly connected together, a closed loop is formed.

Figure 3:
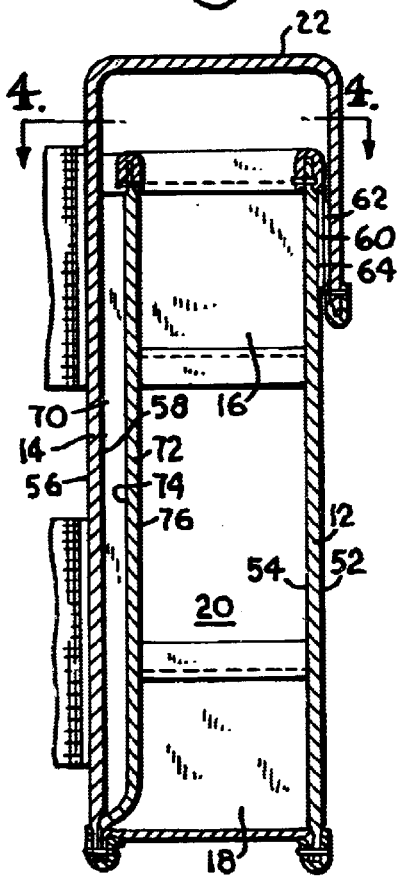
FIG. 3 is a sectional view of the device carrier taken along line 3—3 in FIG. 1.

FIG. 3 is a sectional view of the device carrier, taken along line 3—3 in FIG. 1. Front wall 12 has an outer surface 52 and an inner surface 54 and rear wall 14 has an outer surface 56 and an inner surface 58. In a preferred embodiment, one end of flap 22 is integrally formed with rear wall 14. Alternatively, flap 22 may be fixedly attached to rear wall 14. The opposing end of flap 22 is removably coupled to front wall 12 via connector 60. In a preferred embodiment, hook-and-loop fastening material is utilized as the connector 60. One type of hook-and-loop fastening material 62 is placed on the inner surface of flap 22 and a complimentary section of hook-and-loop fastening material 64 is placed on the outer surface 52 of front wall 12. As would be understood, several connectors such as snaps or buttons would be within the teachings of this invention.

Figure 4:
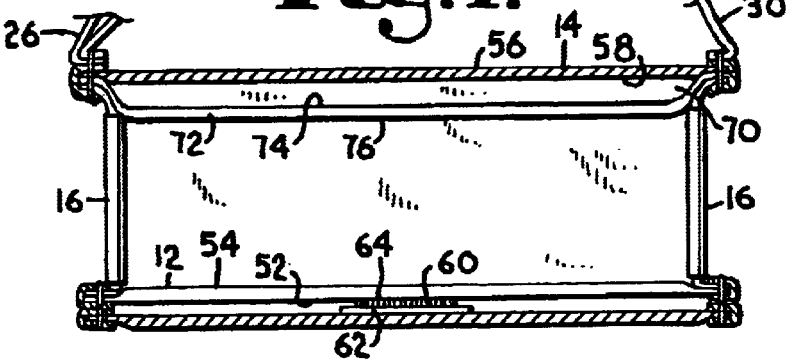
FIG. 4 is a sectional plan view of the device carrier taken along line 4—4 in FIG. 3.

As shown in FIGS. 3 and 4, an inner pocket 70 is formed between an inner wall 72 and the rear wall 14. In a preferred embodiment, the inner wall 70 is attached to the perimeter of the rear wall 14 and the inner wall is manufactured out of a nylon mesh with foam backing.

In operation, the connecting structures 32 on each of the armbands 24 of the carrier are detached and the adjustment straps 30 are pulled through the buckle 28 so that the carrier may be slipped onto the user's arm. After the device carrier is eased over the upper arm of the user, the user can tighten straps 30 and reattach the connecting structures 32 to ensure that the device carrier will not slip or shift during exercise or activity. Specifically, the armbands 24 are adjusted by releasing the second end 47 of the coupled adjustment strap 30 and pulling on the second end 47 of adjustment strap 30 until the desired tension is achieved. The second end 47 of the adjustment strap 30 is then reattached to the mid-section of the adjustment strap 30 using the connection structure 32.

Next, the flap 22 is uncoupled from the front wall and an electronic device is placed into pocket 11. The flap 22 is then closed and coupled with the outer surface of the front wall 12 using the connector 60.

Constructed and operated as previously described, in a preferred embodiment, the device carrier utilizes two armbands 24 that allow the user to wear the device carrier over the upper arm area. The two armband feature allows the upper arm to expand without restrictions to allow for a comfortable fit that may not exist in a single armband feature. The two armband feature also prevents slippage of the device carrier through normal walking or exercise. Additionally, the armbands 24 provide a user with a simple way to adjust the tension in the straps without having to remove the carrier during exercise or other activity. The side openings 20 allow the user to make adjustments to the electronic device being carried without having to open flap 22. Adjustments may include volume control, music selection and access to a headphone jack on the electronic device.

The nylon mesh with foam backing material allows the device carrier to stretch for a tight hold around the device, but also provides padding to absorb shocks to the device. This prevents the electronic device, such as a cassette player or CD player from dragging or skipping. Additionally, this type of fabric is machine washable.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many of possible embodiments may be made oft invention without departing from the scope thereof, it is understood that all matter herein set forth or shown in the accompanying drawings is to be interpreted as illustrative and not in a limiting sense.

Having thus described our invention, we claim:

1. An apparatus for carrying an electronic device, the apparatus comprising:

a pouch having a front wall, a rear wall, an interior wall, a pair of opposed side walls and a base wall, wherein said side walls and said base wall couple said front wall with said rear wall, wherein said interior wall is positioned between said front and rear walls and is coupled to said rear wall, wherein a first envelope is formed between said front wall and said interior wall presenting a first opening, wherein a second envelope is formed between said interior wall and said rear wall presenting a second opening, and wherein said side walls and said base wall are positioned at a distance from one another to define at least one side opening to allow access to said first envelope;

a flap coupled with the rear wall, the flap adapted to be removably coupled with the front wall to cover the first and second openings;

at least two straps, each strap made of an elastic material having a first end, a second end and a side, the first ends coupled with the rear wall spaced apart from one another, the strap further including a first section of hook and loop fastening material coupled to the side and proximate to the second end and a second section of complimentary hook and loop fastening material coupled to the side and located, between the first end and the first section of hook and loop material; and a number of buckles corresponding to the number of straps, each said buckle coupled to the rear wall, wherein each strap is secured to the corresponding buckle, by placing the second end through the buckle and looping the second end over onto itself so that the first and second sections of hook and loop fastening material are directed toward one another and coupled together.

2. The apparatus of claim 1, wherein each of the corresponding buckles further includes a first opening, a center bar and a second opening, wherein the strap is secured to the buckle by placing the second end through the first opening, over the center bar and through the second opening onto itself so that the first and second sections of hook and loop fastening material are directed toward one another and coupled together.

3. The apparatus of claim 1, wherein the pouch, including the interior wall, are made of nylon mesh with a foam backing.

4. The apparatus of claim 1, wherein the armbands are made of an elastic material.

5. The apparatus of claim 1, wherein said flap is removably coupled with said front wall by a hook and loop fastening means.

6. The apparatus of claim 1, wherein said rear wall includes a top edge, and wherein said straps are parallel with the top edge of the rear wall.

7. An apparatus for carrying an electronic device, the apparatus comprising:

a pouch having a front wall, a rear wall having a top edge, an interior wall, a pair of opposed side walls and a base wall, wherein the side walls and the base wall couple the front wall with the rear wall, wherein the interior wall is positioned between the front and rear walls and is coupled to the rear wall, wherein a first envelope is formed between the front wall and the interior wall presenting a first opening, wherein a second envelope is formed between the interior wall and the rear wall presenting a second opening, wherein the side walls and the base wall are positioned at a distance from one another to define an opening to allow access to the first envelope, and wherein the pouch are made of nylon mesh with a foam backing;

a flap coupled with the rear wall, the flap adapted to be removably coupled with the front wall to cover the first and second openings;

at least two straps being parallel with the top edge of the rear wall, each strap made of an elastic material having a first end, a second end and a side, the first ends coupled with the rear wall spaced apart from one another, the strap further including a first section of hook and loop fastening material coupled to the side and proximate to the second end and a second section of complimentary hook and loop fastening material coupled to the side and located between the first end and the first section of hook and loop material; and a number of buckles corresponding to the number of straps and having a first opening, a center bar and a second opening, each said buckle coupled to the rear wall, wherein each strap is secured to the corresponding buckle by placing the second end through the first opening, over the center bar and through the second opening onto itself so that the first and second sections of hook and loop fastening material are directed toward one another and coupled together.

* * * * *